US008229144B2

(12) United States Patent
Hsu et al.

(10) Patent No.: US 8,229,144 B2
(45) Date of Patent: Jul. 24, 2012

(54) METHOD AND SYSTEM FOR SWITCHED BATTERY CHARGING AND LOADING IN A STEREO HEADSET

(75) Inventors: David Hsu, Cupertino, CA (US); John Walley, Ladera Ranch, CA (US)

(73) Assignee: Broadcom Corporation, Irvine, CA (US)

( * ) Notice: Subject to any disclaimer, the term of this patent is extended or adjusted under 35 U.S.C. 154(b) by 1221 days.

(21) Appl. No.: 12/013,291

(22) Filed: Jan. 11, 2008

(65) Prior Publication Data

US 2009/0180649 A1 Jul. 16, 2009

(51) Int. Cl.
*H04R 5/02* (2006.01)

(52) U.S. Cl. ..... 381/311; 381/74

(58) Field of Classification Search ..... 381/74, 381/123, 124, 309, 311, 330, 384, 1, 300; 455/575.2, 569.1, 571–574
See application file for complete search history.

(56) References Cited

U.S. PATENT DOCUMENTS

| | | | | |
|---|---|---|---|---|
| 6,741,708 | B1 * | 5/2004 | Nakatsugawa | 381/79 |
| 2002/0117998 | A1 * | 8/2002 | Olsen | 320/135 |
| 2006/0262949 | A1 * | 11/2006 | Cho et al. | 381/309 |
| 2007/0004466 | A1 * | 1/2007 | Haartsen | 455/572 |

* cited by examiner

*Primary Examiner* — Ha Tran T Nguyen
*Assistant Examiner* — Kevin Quinto
(74) *Attorney, Agent, or Firm* — Thomas, Kayden, Horstemeyer & Risley, LLP

(57) ABSTRACT

Methods and systems for wireless communication are disclosed and may include controlling a loading and/or a charging of a battery source in each earpiece of the wireless stereo headset. The loading control may include switching between the battery sources powering the headset. A remaining power level may be monitored for each of the battery sources. Both earpieces in the headset may be powered utilizing one or both of the battery sources. One of the earpieces in the headset may be powered utilizing one of the battery sources. A total usage time may be stored for each of the battery sources. The loading and charging of the battery sources may be controlled by equalizing the total usage time for each of the battery sources. The earpieces in the headset may be coupled via a tether line, or may be coupled wirelessly.

22 Claims, 4 Drawing Sheets

METHOD AND SYSTEM FOR SWITCHED BATTERY CHARGING AND LOADING IN A STEREO HEADSET

CROSS-REFERENCE TO RELATED APPLICATIONS/INCORPORATION BY REFERENCE

[Not Applicable]

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to wireless communication. More specifically, certain embodiments of the invention relate to a method and system for switched battery charging and loading in a stereo headset.

BACKGROUND OF THE INVENTION

Headphones were originally utilized for personal enjoyment of music without distracting other people in the vicinity of the music source. Headphones may comprise circumaural, earphones, and canal phones. Circumaural headphones cover the ears and are rather large, more attuned for home audio applications as compared to use with portable audio devices. Earphones are typically used in portable audio device applications, with cassette tape, compact disc and MP3 players, for example. The application of earphones later extended into cellular phone applications, typically as a single earpiece, as the danger of operating motor vehicles while utilizing a cellular phone was established.

With the development of wireless technology, wireless headphones have become more and more prevalent. Bluetooth headsets and/or earpieces have expanded significantly in usage as more cellular phone users have discovered the ease of use with hands-free operation, not only in automotive applications, but in any application where hands-free operation is preferred.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

A system and/or method for switched battery charging and loading in a stereo headset, substantially as shown in and/or described in connection with at least one of the figures, as set forth more completely in the claims.

Various advantages, aspects and novel features of the present invention, as well as details of an illustrated embodiment thereof, will be more fully understood from the following description and drawings.

DETAILED DESCRIPTION OF THE INVENTION

Certain aspects of the invention may be found in a method and system for switched battery charging and loading in a stereo headset. Exemplary aspects of the invention may comprise controlling a loading and/or a charging of a battery source in each earpiece of the wireless stereo headset. The loading control may comprise switching between the battery sources powering the headset. A remaining power level may be monitored for each of the battery sources. Both earpieces in the headset may be powered utilizing one or both of the battery sources. One of the earpieces in the headset may be powered utilizing one of the battery sources. A total usage time may be stored for each of the battery sources. The loading and charging of the battery sources may be controlled by equalizing the total usage time for each of the battery sources. The earpieces in the headset may be coupled via a tether line, or may be coupled wirelessly.

Figure 1:
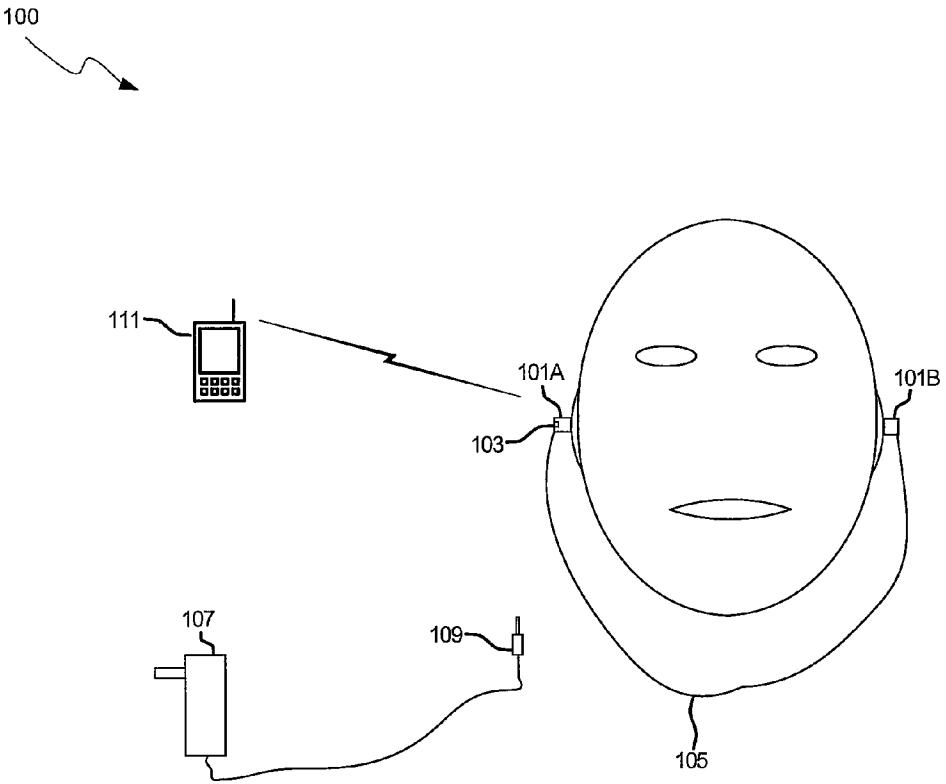
FIG. 1 is a block diagram of an exemplary wireless headset, in accordance with an embodiment of the invention.

FIG. 1 is a block diagram of an exemplary wireless headset, in accordance with an embodiment of the invention. Referring to FIG. 1, there is shown a wireless headset 100 comprising ear buds, or ear pieces 101A and 101B and a tether wire 105. The tether wire 105 may provide an electrical connection between the two ear pieces 101A and 101B for audio and/or control signals and/or supply voltage. The ear pieces 101A and 101B may be described further with respect to FIG. 2. There is also shown a charging port 103, a charger 107, a charger connector 109 and a wireless device 111. In another embodiment of the invention, the ear pieces may be supported by a rigid structure as opposed to the tether wire 105. In yet another embodiment of the invention, ear pieces 101A and 101B may not be physically connected and may only communicate wirelessly, by Bluetooth, for example.

Figure 2:
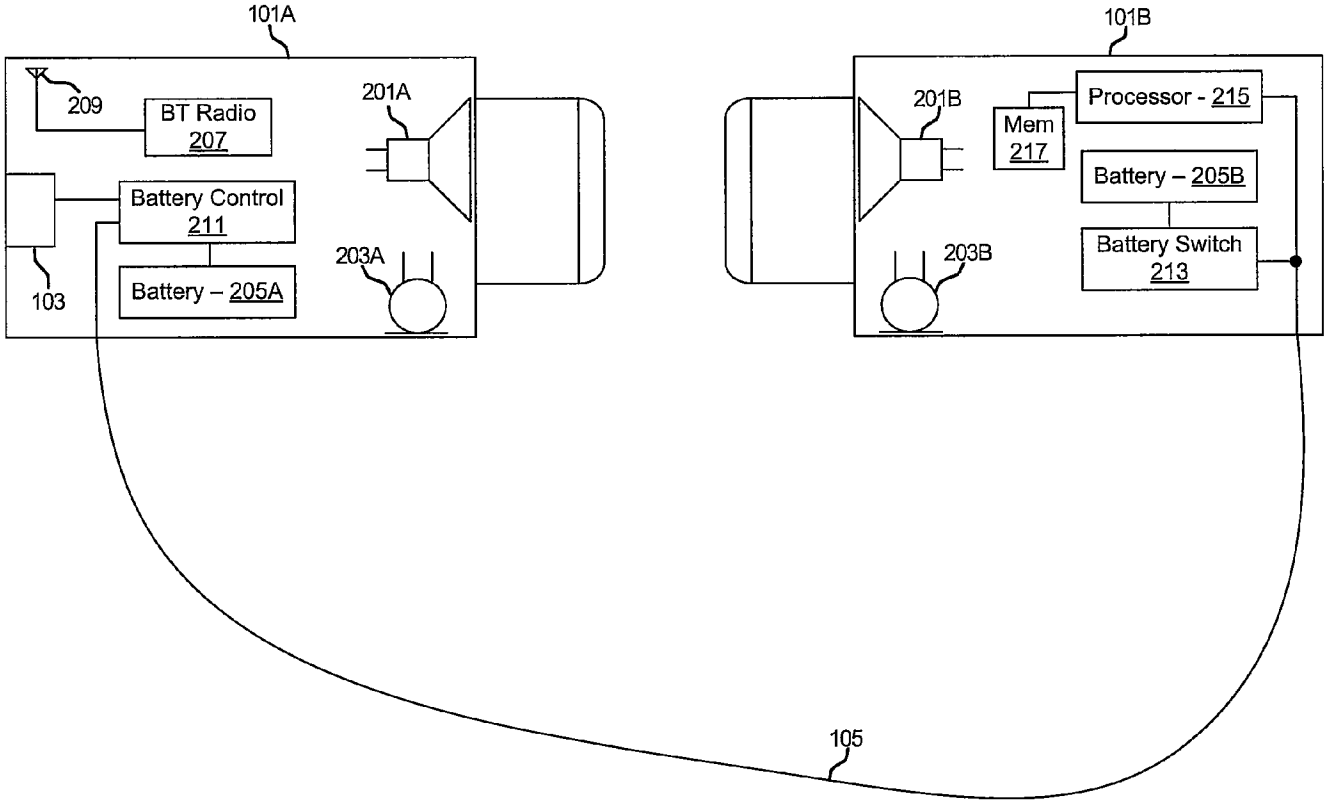
FIG. 2 is a block diagram illustrating an exemplary ear piece schematic, in accordance with an embodiment of the invention.

The ear pieces 101A and 101B may also comprise one or more circuits and one or more batteries for controlling the powering of the wireless headset 100, which may be located internal to the wireless headset 100, as described with respect to FIG. 2. The power control may comprise determining which battery may be utilized at a given time, and also the charging routine to be followed to optimize power usage and/or battery charging, and also to optimize battery lifetime.

The charger 107 may comprise suitable circuitry, logic and/or code that may be enabled to charge the batteries in the wireless headset 100. The charger connector 109 may be utilized to couple the charger 107 to the wireless headset 100 at the charging port 103.

The wireless headset 100 may comprise power handling capability that may be utilized to optimize the charging and loading of the one or more batteries in each of the ear pieces 101A and 101B. The power handling and charging control may be controlled by circuitry in one ear piece that controls power handling and charging in the other earpiece via the tether wire 105 and/or Bluetooth signals. In another embodiment of the invention, the power handling circuitry may be entirely within the earpiece 101A, which may then control the use and charging of one or more batteries in the earpiece 101B via the tether wire 105 and/or Bluetooth signals. The wireless device 111 may comprise suitable circuitry, logic and/or code that may enable wireless communication between the user of the headset 100 and other wireless devices and users. The wireless device may comprise a cellular phone, or a handheld wireless communication and/or entertainment device, for example.

In operation, the wireless headset 100 may be powered by batteries internal to each of the ear pieces 101A and 101B in the wireless headset 100. The wireless headset 100 may be enabled to playback audio signals received wirelessly from sources such as the wireless device 111, for example. In instances when the battery voltage in one of the ear pieces 101A and 101B may drop below a threshold value required to power the wireless headset 100, the wireless headset 100 may switch to a battery in the other ear piece 101A or 101B. The loading of the batteries may be optimized as per the requirements of the particular type of batteries used. For example, in instances where lithium batteries may be used, each battery may be drained as far as possible while still allowing operation of the wireless headset 100, before switching over to another battery.

Similarly, the batteries may be charged as per the requirements of the particular type of batteries used. For example, in instances where lithium batteries may be used, each battery may be charged completely during charging before switching to another battery. In addition, the batteries may be in operation in both ear pieces at the same time, as in stereo music playback mode, for example, or may switch to only one battery and one ear piece 101A or 101B in operation, such as during a monaural (mono) voice call. In this manner, a battery usage versus device performance optimization may be defined as per current battery levels and/or user preference.

FIG. 2 is a block diagram illustrating an exemplary ear piece schematic, in accordance with an embodiment of the invention. Referring to FIG. 2, there is shown the ear pieces 101A and 101B and the tether wire 105. The tether wire 105 and the charging port 103 may be as described with respect to FIG. 1. The ear piece 101A may comprise a speaker 201A, a microphone 203A, a battery 205A, a BT radio 207, an antenna 209 and a battery control circuit 211. The earpiece 101B may comprise a speaker 201B, a microphone 203B, a battery 205B, a battery switch 213, a processor 215 and a memory 217.

The speakers 201A and 201B may comprise suitable circuitry, logic and/or code for converting electrical signals generated by the BT radio 207 and/or the microphones 203A and 203B into audio signals. The microphones 203A and 203B may comprise suitable circuitry, logic and/or code for converting received audio signals into electrical signals that may be transmitted by the BT radio 207 to the wireless device 111, described with respect to FIG. 1.

The batteries 205A and 205B may each comprise one or more batteries for powering the headset 100. One or more batteries may be incorporated into each earpiece 101A and 101B, such that the earpieces 101A and 101B may operate independently, or in a dependent mode where the one or more battery from one ear piece may provide power for both ear pieces 101A and 101B. The battery 205A may be coupled to the battery control circuit 211 and the battery 205B may be coupled to the battery switch 213.

The BT radio 207 may comprise suitable circuitry, logic and/or code for communicating wirelessly with BT devices, such as the wireless device 111, for example, described with respect to FIG. 1. The BT radio 207 may enable communication of signals received from the microphones 203A and/or 203B via the processor 215 to the wireless device 111 via the antenna 209. Similarly, the BT radio 207 may be enabled to communicate wireless signals received from the wireless device 111 to the speakers 201A and/or 201B. In another embodiment of the invention, the earpiece 101B may also comprise a BT radio, such as the BT radio 207, such that audio and/or control signals may communicated without the need of a tether wire.

The antenna 209 may comprise suitable circuitry, logic and/or code that may enable transmission and/or reception of wireless signals. The antenna 209 may be communicatively coupled to the BT radio 207 and may be configured to operate in the Bluetooth frequency spectrum, for example.

The battery control circuit 211 may comprise suitable circuitry, logic and/or code that may enable controlling the power usage of the batteries 205A and 205B. The battery control circuit 211 may enable sensing of the remaining power levels in the batteries 205A and 205B for determining which battery may be utilized to power the ear pieces 101A and 101B at any given time. In addition, the battery control circuit 211 may determine which battery 205A or 205B may be charged first when the headset 100 may be coupled to the charger 107, described with respect to FIG. 1.

The battery switch 213 may comprise suitable circuitry, logic and/or code that may enable switching the battery 205B in and out of operation and may be controlled by the battery control circuit 211. In this manner, one or both of the batteries 205A and 205B may be utilized to power the earpieces 101A and 101B.

The processor 215 may comprise suitable circuitry, logic and/or code that may enable control of the earpieces 101A and 101B. The processor 215 may control the battery control circuit 211, the BT radio 207, and any other component that may require processing capability. The processor 215 may be enabled to generate baseband signals from signals received from the microphone such that they may be transmitted by the BT radio 207. The processor 215 may be located in the earpiece 101B as shown in FIG. 2, or may be located in the earpiece 101A. In another embodiment of the invention, the processor 215 may comprise two separate processors, with one processor located in each earpiece 101A and 101B.

The memory 217 may comprise suitable circuitry, logic and/or code that may enable storage of data for the processor 215. The memory 217 may be enabled to store usage times for the batteries 205A and 205B, so that the battery control circuit 211 may equalize the battery charging and loading over time.

In operation, the ear pieces 101A and 101B may be enabled to communicate audio signals to the speakers 201A and/or 201B from the BT radio 207 and to communicate signals from the microphones 203A and/or 203B to the BT radio 207 for transmission to an external device, such as the wireless device 111, described with respect to FIG. 1.

The battery control circuit 211 may sense the power levels remaining in the batteries 205A and 205B, and control which battery may be utilized to supply power for the ear pieces 101A and 101B. In an embodiment of the invention, the battery control circuit 211 may enable both batteries 205A and 205B to operate the ear pieces 101A and 101B, such as for stereo music playback, for example, where the power levels of both batteries may be sufficient. In instances where a battery voltage of one of the batteries, battery 205A, for example, may be reduced to near the minimum voltage needed to power the ear pieces 101A and/or 101B, the battery control circuit 211 may switch over to the other battery, the battery 205B in this example.

The battery control circuit 211 may also control the charging characteristics of the batteries 205A and 205B. The battery control circuit 211 may alternate charging and loading such that the usage of the batteries may be essentially equal over time. For example, in instances where the ear pieces 101A and 101B may be powered by the battery 205A for a period of time such that the voltage on the battery 205A may be reduced, and a charger, such as the charger 107 may be coupled to the earpiece 101A via the charge port 103, the battery 205A may be charged. Subsequently, the battery control circuit 211 may switch over to the battery 205B to be utilized as the primary power source to ensure uniform usage of the batteries 205A and 205B and to allow for a recharge period if necessary, as opposed to always using one battery first and the other battery as a backup.

The processor 215 may control various operations of the components in the earpieces 101A and 101A, and may comprise a baseband processor for processing of signals to be transmitted by the BT radio 207. Additionally, the processor 215 may control the battery control circuit 211 via loading and charging algorithms configured for optimum lifetime of a particular type of battery utilized, lithium, or nickel-metal hydride, for example. The processor 215 may utilize the memory 217 for storing data generated in the operation of the earpieces 101A and 101B. The memory 217 may also be utilized for storing algorithms utilized to control the battery control circuit 211.

In an embodiment of the invention, the processor 215 and the battery control circuit may enable one or more battery "fuel gauges" that may indicate the remaining charge level in the batteries 205A and/or 205B. The remaining charge level may be utilized to determine which battery or batteries may be utilized for a given application. The fuel gauges may comprise a visual indicator on the earpieces 101A and/or 101B, with a number of segments or LEDs, wherein the number of segments or LEDs illuminated may correspond to a charge level. In another embodiment of the invention, the fuel gauges may comprise a numerical indicator on the display of the earpiece 101A and/or 101B that may correspond to the level of charge in the batteries.

In another embodiment of the invention, the earpieces 101A and 101B may each comprise a BT radio, such as the BT radio 207 so that the earpieces may not require the tether 105 for coupling. In this embodiment, a battery control circuit may be utilized in each earpiece to control the battery usage. In this manner, battery control commands may be transmitted and received by BT radios in the earpieces 101A and 101B. For example, for a mono voice call, one of the earpieces, such as the earpiece 101B may be idled while the other earpiece 101A may be utilized to take a call.

Figure 3:
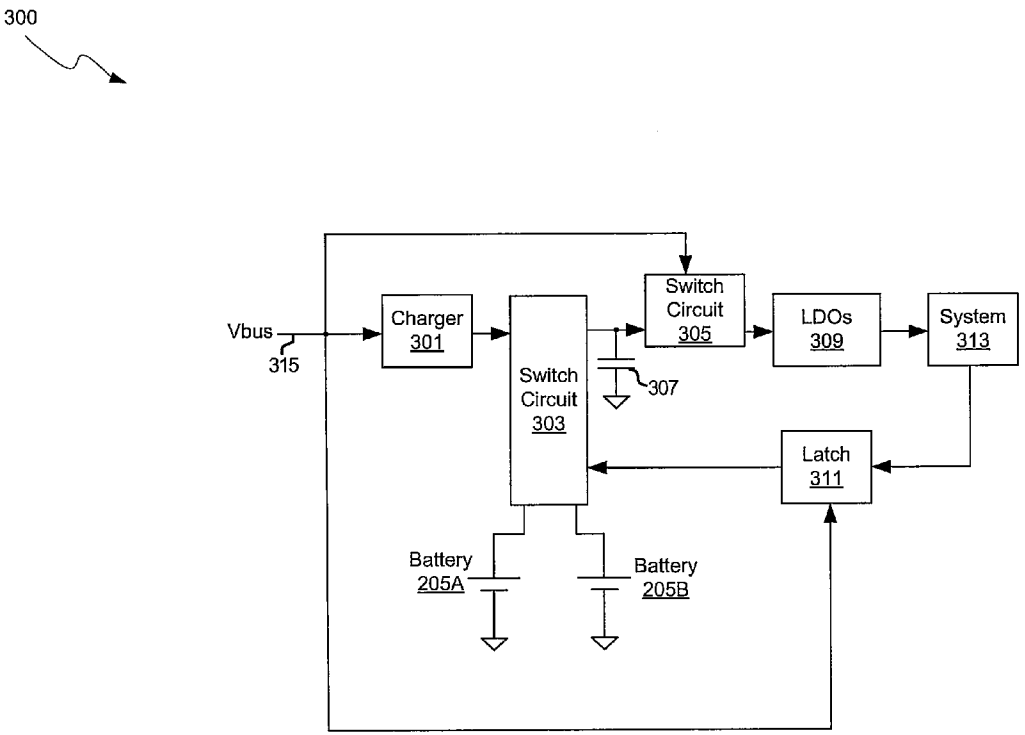
FIG. 3 is a block diagram illustrating an exemplary power control circuit, in accordance with an embodiment of the invention.

FIG. 3 is a block diagram illustrating an exemplary power control circuit, in accordance with an embodiment of the invention. Referring to FIG. 3, there is shown a power control circuit 300 comprising a charger circuit 301, switch circuits 303 and 305, the batteries 205A and 205B, a capacitor 307, a voltage regulator block 309, a latch 311 and a system block 313. There is also shown a bus voltage ($V_{bus}$) 315. The batteries 205A and 205B may be as described with respect to FIG. 2.

The charger circuit 301 may comprise suitable circuitry, logic and/or code that may enable charging of the batteries 205A and 205B. The charger 301 may receive as an input the voltage $V_{bus}$ 315 which may be supplied by an external power source, such as the charger 107, described with respect to FIG. 1. The charger may be coupled to the switch circuits 303 and 305 and the capacitor 307.

The switch circuits 303 and 305 may comprise suitable circuitry, logic and/or code that may enable switching between power sources, such as the batteries 205A and 205B and the $V_{bus}$ 315. The switch circuit 303 may be coupled to the batteries 205A and 205B, the latch 311, the charger 301, the capacitor 307 and the switch circuit 305, and may be utilized to switch between the batteries 205A and 205B. The switch circuit 305 may be coupled to the $V_{bus}$ 315, the charger 301, the switch circuit 303 and the voltage regulator block 309, and may enable switching between the batteries 205A and/or 205B and the $V_{bus}$ 315 for powering the voltage regulator block 309. The switch circuit 303 may be controlled by the latch 311.

The capacitor 307 may be coupled across an input to the switch 303B and ground, and may enable storage of charge for reducing fluctuations in the voltage supplied to the voltage regulator block 309 in instances of switching between sources, such as the $V_{bus}$ 315 and the batteries 205A and 205B.

The voltage regulator block 309 may comprise suitable circuitry, logic and/or code that may enable providing a constant voltage to the system 313, nearly independent of the input voltage to the voltage regulator block 309. The voltage regulator block 309 may comprise low drop out voltage regulators that may enable an output voltage minimally reduced from the input voltage.

The latch 311 may comprise suitable circuitry, logic and/or code that may enable controlling the switch circuit 303. The latch 311 may receive an input signal from the system 313 and generate an output signal that may be utilized to activate the switch circuit 303. The latch 311 may also receive as an input the bus voltage, $V_{bus}$ 315, such that the switch circuit 303 may be enabled even when the voltages of the batteries 205A and 205B may be too low for normal operation.

The system 313 may comprise the remaining circuitry in the earpieces 101A and 101B, such as the BT radio 207, the speakers 201A and 201B, the microphones 203A and 203B, the processor 215 and other circuitry required for operation of the headset 100.

In operation, the power control circuit 300 may provide power for the operation of the system 313. The switch circuit 303 may be utilized to select one or both of the batteries 205A and 205B to supply a voltage to the voltage regulator block 309 via the switch circuit 305. In instances where a charger may be coupled to the power control circuit via a supply voltage, $V_{bus}$ 315, the charger 301 may be enabled to charge one of the batteries 205A and 205B. The supply voltage $V_{bus}$ 315 may also be communicated to the voltage regulator block 309 via the switch circuit 305.

The system 313 may generate an output signal, via the processor 215, for example, activating the latch 311 to set the switch circuit 303 to the desired battery, so that battery 205A and/or 205B may be coupled to the switch circuit 305 via the switch circuit 303. Algorithms may be utilized to control the loading and charging of the batteries 205A and 205B to optimize the lifetimes of the batteries. This may be accomplished by equalizing the usage time of each battery 205A and 205B. For example, in instances where the battery 205A may be utilized and allowed to drain most of the charge, and where a charger may subsequently be coupled to the wireless headset 100, the battery 205A may be charged, and the battery 205B may be utilized next to power the wireless headset 100 to equalize the usage of the batteries. The algorithms may be optimized for a particular type of battery used, and may depend on whether the battery type lasts longer when allowed to completely drain before charging, and whether a recharge state may be required after charging, for example.

Figure 4:
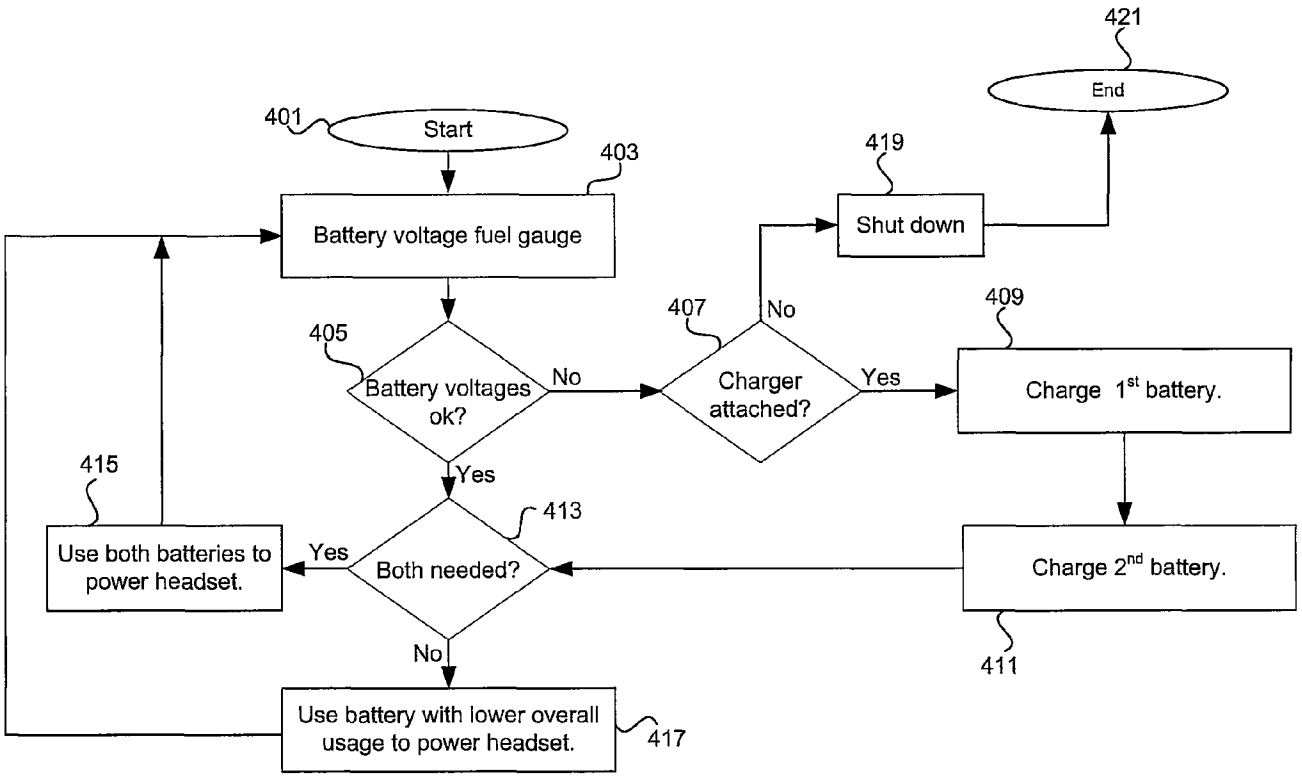
FIG. 4 is a flow diagram illustrating an exemplary dual battery charging and loading process, in accordance with an embodiment of the invention.

FIG. 4 is a flow diagram illustrating an exemplary dual battery charging and loading process, in accordance with an embodiment of the invention. Referring to FIG. 4, in step 403, after start step 401, the battery voltages may be checked. In step 405, if the voltages may be low, the exemplary steps may proceed to step 407. If in step 407 a charger may be coupled to the headset, the process may proceed to step 409, where the first battery may be charged, followed by step 411 where the second battery may be charged. If, in step 407, the battery voltages are low and no charger may be present, the headset may shut down in step 419, followed by end step 421.

If, in step 405, the battery voltages may be suitable for operation of the headset, the exemplary steps may proceed to step 413. If, in step 413, if both batteries may be needed for a particular mode of operation, the exemplary steps may proceed to step 415 where the headset may powered by both batteries, and then proceed to step 403, to repeat. If both batteries may not be required in step 413, the battery with lower overall usage may be utilized to power the headset in step 417 before proceeding to step 403 to repeat the process.

In an exemplary embodiment of the invention, a method and system are disclosed for switched battery charging and loading in a stereo headset 100 and may comprise controlling a loading and/or a charging of a battery source 205A and 205B in each earpiece 101A and 101B of the wireless stereo headset 100. The loading control may comprise switching between the battery sources 205A and 205B powering the wireless stereo headset 100. A remaining power level may be monitored for each of the battery sources 205A and 205B. Both earpieces 101A and 101B in the wireless stereo headset 100 may be powered utilizing one or both of the battery sources 205A and 205B. One of the earpieces 101A or 101B in the wireless stereo headset 100 may be powered utilizing one of the battery sources 205A or 205B. A total usage time may be stored for each of the battery sources 205A and 205B. The loading and charging of the battery sources 205A and 205B may be controlled by equalizing the total usage time for each of the battery sources 205A and 205B. The earpieces in the wireless stereo headset 100 may be coupled via a tether line 105, or may be coupled wirelessly.

Certain embodiments of the invention may comprise a machine-readable storage having stored thereon, a computer program having at least one code section for wireless communication, the at least one code section being executable by a machine for causing the machine to perform one or more of the steps described herein.

Accordingly, aspects of the invention may be realized in hardware, software, firmware or a combination thereof. The invention may be realized in a centralized fashion in at least one computer system or in a distributed fashion where different elements are spread across several interconnected computer systems. Any kind of computer system or other apparatus adapted for carrying out the methods described herein is suited. A typical combination of hardware, software and firmware may be a general-purpose computer system with a computer program that, when being loaded and executed, controls the computer system such that it carries out the methods described herein.

One embodiment of the present invention may be implemented as a board level product, as a single chip, application specific integrated circuit (ASIC), or with varying levels integrated on a single chip with other portions of the system as separate components. The degree of integration of the system will primarily be determined by speed and cost considerations. Because of the sophisticated nature of modern processors, it is possible to utilize a commercially available processor, which may be implemented external to an ASIC implementation of the present system. Alternatively, if the processor is available as an ASIC core or logic block, then the commercially available processor may be implemented as part of an ASIC device with various functions implemented as firmware.

The present invention may also be embedded in a computer program product, which comprises all the features enabling the implementation of the methods described herein, and which when loaded in a computer system is able to carry out these methods. Computer program in the present context may mean, for example, any expression, in any language, code or notation, of a set of instructions intended to cause a system having an information processing capability to perform a particular function either directly or after either or both of the following: a) conversion to another language, code or notation; b) reproduction in a different material form. However, other meanings of computer program within the understanding of those skilled in the art are also contemplated by the present invention.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A method for wireless communication, comprising:

in a wireless stereo headset comprising a battery source in each earpiece of said wireless stereo headset, controlling loading and/or charging of each of said battery sources of said wireless stereo headset and storing a total usage time for each of said battery sources.

2. The method according to claim 1, comprising switching between said battery sources powering said wireless stereo headset for said controlling of said loading.

3. The method according to claim 1, comprising monitoring a remaining power level of each of said battery sources.

4. The method according to claim 1, comprising powering both of said earpieces in said wireless stereo headset utilizing both of said battery sources.

5. The method according to claim 1, comprising powering one of said earpieces in said wireless stereo headset utilizing one of said battery sources.

6. The method according to claim 1, comprising powering both of said earpieces in said wireless stereo headset utilizing one of said battery sources.

7. The method according to claim 1, comprising controlling said loading of said battery sources by equalizing said total usage time for each of said battery source.

8. The method according to claim 1, comprising controlling said charging of said battery sources by equalizing said total usage time for each of said battery source.

9. The method according to claim 1, wherein said earpieces in said wireless stereo headset are coupled via a tether line.

10. The method according to claim 1, wherein said earpieces in said wireless stereo headset are coupled wirelessly to each other.

11. A system for wireless communication, the system comprising:

one or more circuits in a wireless stereo headset, said wireless stereo headset comprising a battery source in each earpiece of said wireless stereo headset, said one or more circuits control loading and/or charging of each of said battery sources in said wireless stereo headset and stores a total usage time for each of said battery sources.

12. The system according to claim 11, wherein said one or more circuits switches between said battery sources powering said wireless stereo headset for said loading control.

13. The system according to claim 11, wherein said one or more circuits monitors a remaining power level of each of said battery sources.

14. The system according to claim 11, wherein said one or more circuits enables powering both of said earpieces in said wireless stereo headset utilizing both of said battery sources.

15. The system according to claim 11, wherein said one or more circuits enables powering one of said earpieces in said wireless stereo headset utilizing one of said battery sources.

16. The system according to claim 11, wherein said one or more circuits enables powering both of said earpieces in said wireless stereo headset utilizing one of said battery sources.

17. The system according to claim 11, wherein said one or more circuits controls said loading of said battery sources by equalizing said total usage time for each of said battery source.

18. The system according to claim 11, wherein said one or more circuits controls said charging of said battery sources by equalizing said total usage time for each of said battery source.

19. The system according to claim 11, wherein said earpieces in said wireless stereo headset are coupled via a tether line.

20. The system according to claim 11, wherein said earpieces in said wireless stereo headset are coupled wirelessly to each other.

21. A system for wireless communication, comprising:

in a wireless stereo headset comprising a battery source in each earpiece of said wireless stereo headset, said wireless stereo headset comprising means for controlling loading and/or charging of each of said battery sources of said wireless stereo headset and means for storing a total usage time for each of said battery sources.

22. The system of claim 21, wherein said wireless stereo headset further comprises means for controlling said loading of said battery sources by equalizing said total usage time for each of said battery source.

* * * * *